United States Patent [19]

Eastman

[11] Patent Number: 4,547,130

[45] Date of Patent: Oct. 15, 1985

[54] CAPILLARY INPUT FOR PUMPS

[75] Inventor: George Y. Eastman, Lancaster, Pa.

[73] Assignee: Thermacore, Inc., Lancaster, Pa.

[21] Appl. No.: 579,864

[22] Filed: Feb. 13, 1984

[51] Int. Cl.[4] ..... F04B 21/00

[52] U.S. Cl. ..... 417/53; 55/466; 62/55.5; 417/313

[58] Field of Search ..... 417/313; 55/466, 269; 62/55.5; 98/43 R

[56] References Cited

U.S. PATENT DOCUMENTS

| | | | |
|---|---|---|---|
| 2,970,669 | 2/1961 | Bergson | 55/466 X |
| 3,364,658 | 1/1968 | Walker | 55/466 |
| 4,352,392 | 10/1982 | Eastman | 165/104.25 |

*Primary Examiner*—Edward K. Look

*Attorney, Agent, or Firm*—Martin Fruitman

[57] ABSTRACT

A condensation collector for accumulating liquid for input to a pump. The collector is a device which is independent of gravity for feeding a pump collecting condensate from a vapor system. A decreasing cross section condenser is cooled to the dew point of the vapor with which it is in contact, and the interior of the collector can be a highly wettable surface or be lined with a capillary material. The collector itself has a narrow region so that as it approaches the pump input it also acts as a capillary pump. Condensed liquid is therefore fed into the pump by the collector regardless of the absence of gravity.

11 Claims, 4 Drawing Figures

CAPILLARY INPUT FOR PUMPS

SUMMARY OF THE INVENTION

This invention deals generally with liquid and vapor circulating systems and more specifically with an apparatus and method for feeding a liquid pump from a vapor environment without the use of gravity.

The traditional method of feeding a liquid pump, that is supplying liquid to it, is to use the force of gravity. Typically, liquid is collected in a container, a sump, into which the input pipe of the pump is immersed, and the pump "sucks" the liquid up from the sump. Such arrangements are apparent in many common applications. The household well pump, sump pump and aquarium pump and the automobile fuel pump are typical examples. In all these applications the pump input pipe ultimately is fed by a pool of liquid accumulated by gravity.

Similarly, in two phase systems, those in which liquid vapor is condensed before being fed to the liquid pump, the pump is typically located at a low point in order to take advantage of gravity to feed its input. U.S. Pat. No. 4,352,392 by Eastman shows the typical orientation of such a system in which a sump below a vapor condensing surface accumulates liquid for feeding a pump.

However, in high technology cooling systems it is not always possible to use gravity to collect liquid. Such systems may be located in a gravity-free environment, such as in outer space, or their physical geometry may require liquid collection in an orientation which is not aided by gravity.

The present invention permits feeding liquid condensate to a pump regardless of the absence of gravity and, therefore, facilitates the collection of liquid condensed from vapor in gravity-free satellite systems applications. This is accomplished by constructing the liquid collector which feeds the pump in the configuration of a small angled cone or other geometry which decreases in cross section, lining the inside of the collector at its widest opening region with a liquid wettable or capillary material and cooling the collector walls below the dew point of the vapor being collected. The exterior of the collector is either insulated or isolated from contact with the vapor.

The vapor therefore condenses on inside, capillary covered or wettable walls of the collector and is moved toward the small end of the collector by capillary pressure. As the collector narrows down, a location is reached at which the collector itself becomes a capillary tube and at that point the liquid bridges the entire collector section forming a slug of liquid. This slug of liquid is the source for the pump attached somewhere beyond this point of formation. Since the collector casing itself acts as a capillary tube beyond this location, no lining of capillary material is required near the pump input. The point at which the wettable surface or capillary lining is discontinued varies with the angle of the cone, the diameter of the pump input, the liquid properties and the pump flow rate. It can be further adjusted by the use of multiple small capillary tubes on the input to the pump as opposed to a single pipe input. Depending upon the specific application and the geometry of the system, the wettable surface or capillary lining can be omitted and the vapor condensed directly into a capillary action collector.

In either design, the system can feed a pump with collected condensate without the aid of gravity.

DETAILED DESCRIPTION OF THE INVENTION

Figure 1:
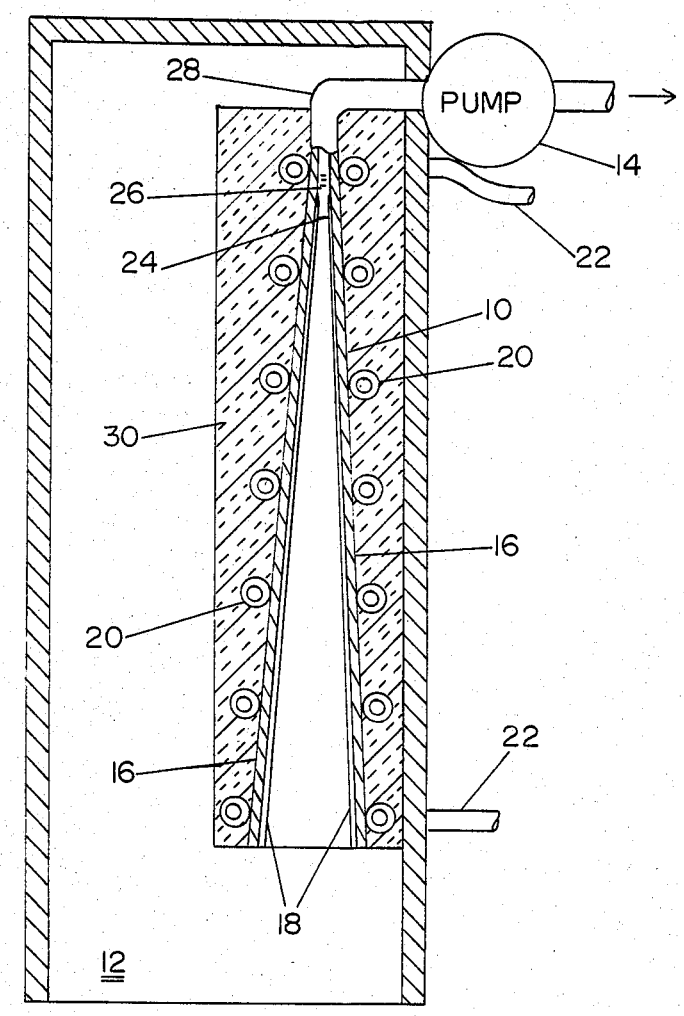
FIG. 1 is a partial cross sectional view of the preferred embodiment of the invention in which the collector is formed in a conical configuration.

FIG. 1 is a partial cross sectional view of the preferred embodiment of the invention in which conical collector 10 is located within vapor region 12 and feeds liquid pump 14. Vapor region 12 contains vapor generated from a remote source (not shown), and conical collector 10 is located completely within region 12. Collector casing 16 is constructed of a heat conductive material and is lined with capillary layer 18 on the inside. Cooling pipes 20 are attached to the outside surface of collector 10 and, in operation, the coolant passing through pipes 20 cools collector 10 below the dew point of the vapor and causes condensate to form upon and within capillary layer 18. Pipes 20 are furnished with coolant from an external source (not shown) through feed pipes 22.

Capillary layer 18 accumulates the condensed liquid, and, by capillary pumping, moves it along the inner surface of collector 10 to the collector output at pump 14. Conical collector 10 is constructed with an angle of less than 10 degrees, so that as it narrows down, a point 24 is reached at which liquid 26 bridges the cross section of collector 10. From point 24 on, collector 10 and collector output pipe 28 are completely filled with liquid 26, and pump 14 therefore feeds from a liquid source.

Insulation 30 is used to cover the outer surfaces of collector 10 and cooling pipes 20 to prevent condensation on surfaces which are not part of the pump feed system.

Figure 2:
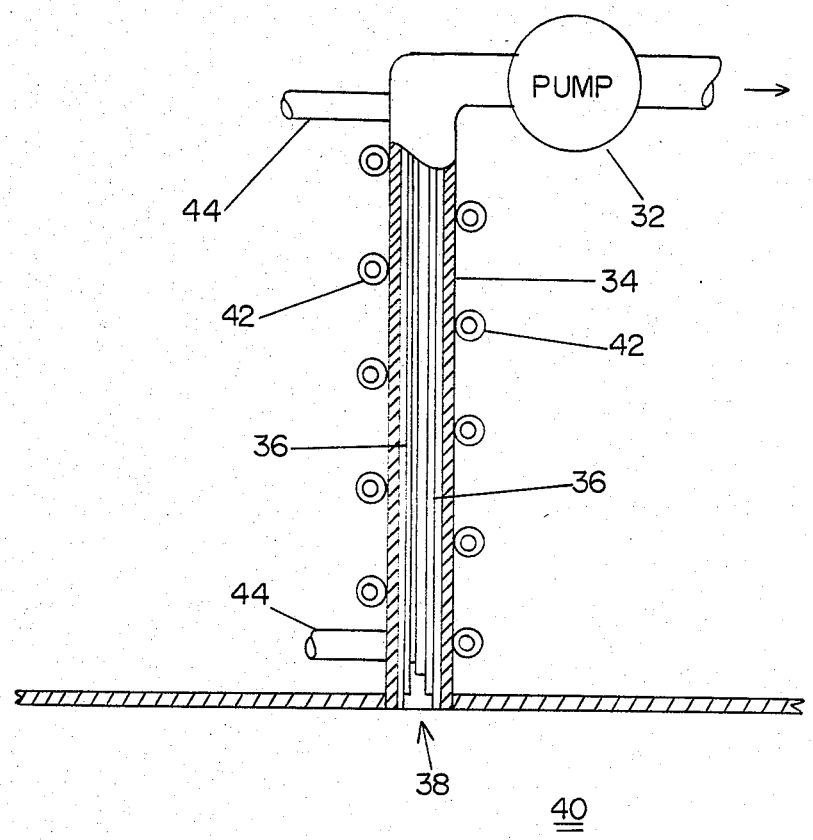
FIG. 2 is a partial cross sectional view of an alternate embodiment of the invention in which the capillary sump is formed of multiple tubes.

FIG. 2 depicts an alternate embodiment of the invention in which pump 32 is fed by collector 34 which is not conical in shape. Collector 34 is, instead, constructed of multiple small capillary tubes 36, the ends 38 of which are exposed to vapor chamber 40 at the collector input. Cooling pipes 42, supplied by feed pipes 44 cool the outside of collector 34, thus cooling capillary tubes 36 by conduction to form condensate at ends 38 and within capillary tubes 36. This condensate is delivered to pump 32 by the capillary pumping action of tubes 36 so that pump 32 is supplied by a system which is essentially the equivalent of multiple conical collectors.

As shown in FIG. 2 condensation can be prevented without insulating the collector. Collector 34 and cooling pipes 42 are located external to and as an appendage attached to vapor chamber 40. Their outer surfaces are therefore isolated from condensable vapor rather than insulated as in FIG. 1. Regardless of the means for preventing external condensation, the collector interior and capillary system are cooled below the point at which condensation takes place and the capillary system collects liquid in sufficient quantities to fulfill the input requirements of the pump.

Figure 3:
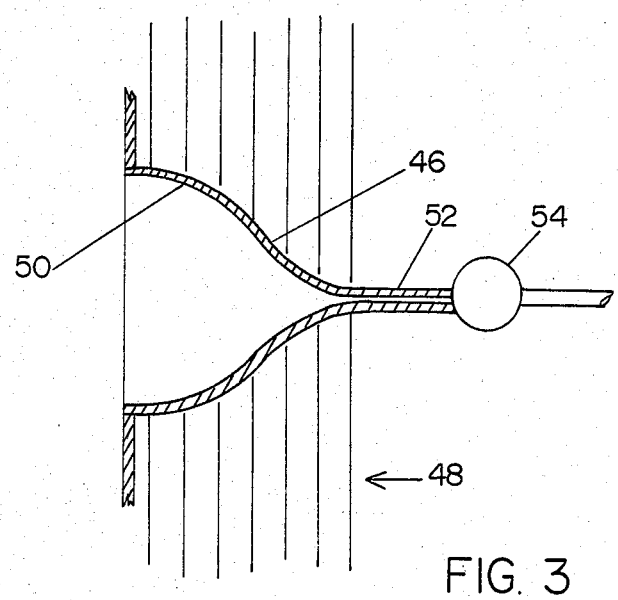
FIG. 3 is a partial cross sectional view of a collector with an alternate configuration which uses fins for cooling.

FIG. 3 shows curved surface collector 46 cooled by fins 48 which themselves can be cooled by either radiation or forced or natural convection of fluid. Collector 46 is, however, shown without a capillary layer and its action is instead dependent upon the wettability of its inner surface 50. The wettable inner surface, whether in collector 46 or in any other collector configuration, will essentially cause the condensate to spread out over the entire inner surface of the collector in a thin film. As this film progresses into pump input pipe 52 it will, as previously explained, fill pipe 52 due to the capillary action of input pipe 52. Pump 54 will then pump the liquid in conventional fashion.

Figure 4:
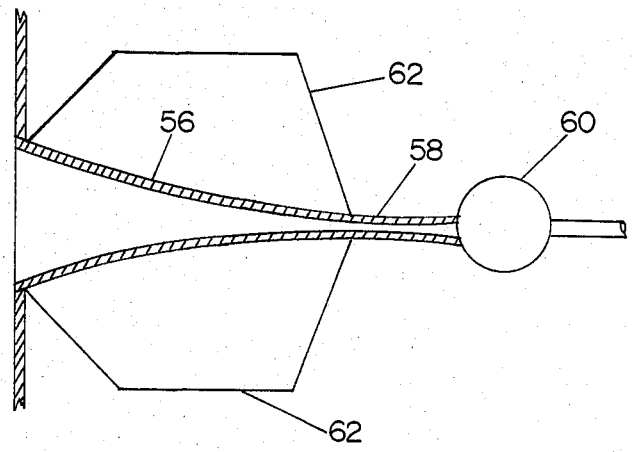
FIG. 4 shows a second alternative collector with a flared configuration and fins.

FIG. 4 shows another of the possible configuration of collector 56 as a flared pipe cooled by radiation fins 62. The essential criteria for any collector is that the collector decrease in cross section to a point where the diameter of pump input pipe 58, the flow rate of pump 60, and the characteristics of the condensing liquid permit the liquid to close up the input pipe after the collector surface has transported the liquid to the input pipe by either capillary action or the dispersion of liquid due to wettability of the inner surface of the collector.

It is to be understood that the forms of this invention as shown are merely preferred embodiments. Various changes may be made in the function and arrangement of parts; equivalent means may be substituted for those illustrated and described; and certain features may be used independently from others without departing from the spirit and scope of the invention as defined in the following claims.

For instance, the cooling could be by means other than gas or liquid coolant, such as thermoelectric cooling. Also, the vapor chamber can have the non-condensible gases evacuated from it to permit its operation as a heat pipe.

What is claimed as new and desired to be secured by Letters Patent of the United States is:

1. An apparatus for supplying liquid to a pump from a vapor environment without the aid of gravity comprising:

a pump for moving liquid;

a collector comprising an enclosed volume the collector outlet being attached to and opening into the input of the pump and the collector input being open to a vapor environment, the collector outlet being of such dimensions so as to act as a capillary feeding liquid to the input of the pump and so as to cause collected liquid to bridge the cross section of the collector outlet without the aid of gravity;

cooling means attached to the collector and capable of cooling the inside of the collector to cause vapor from the vapor environment to condense within the collector; and transport means to transport liquid from the point of condensation within the collector to the collector outlet.

2. An apparatus for supply of liquid to a pump as in claim 1 wherein the collector is constructed with a conical inner surface.

3. An apparatus for supply of liquid to a pump as in claim 1 wherein the transport means is a capillary layer upon the collector inner surface, with the capillary layer extending into the collector outlet.

4. An apparatus for supply of liquid to a pump as in claim 1 wherein the cooling means are liquid cooling pipes attached to the collector.

5. An apparatus for supply of liquid to a pump as in claim 1 wherein the collector is located within the vapor environment and the exterior surfaces of the collector are covered with thermal insulating material.

6. An apparatus for supply of liquid to a pump as in claim 1 wherein the transport means is a wettable inner surface of the collector.

7. An apparatus for supply of liquid to a pump as in claim 1 wherein the cooling means are fins attached to the collector.

8. An apparatus for supply of liquid to a pump as in claim 1 wherein the collector comprises a group of capillary tubes.

9. An apparatus for supply of liquid to a pump as in claim 1 wherein the collector configuration is a flared pipe.

10. A method for supplying liquid to a pump from a vapor environment without the aid of gravity comprising:

condensing liquid onto the inside surface of a collector, the input of which is open to the vapor environment and the output of which is attached to and feeding the pump, the collector output being formed to act as a capillary feeding liquid to the input of the pump and to cause collected liquid to bridge the cross section of the collector output without the aid of gravity; and transporting the condensed liquid from the area of condensation to the collector output by the use of a capillary pumping means.

11. A method for supplying liquid to a pump from a vapor environment without the aid of gravity comprising:

condensing liquid onto the inside surface of a collector, the input of which is open to the vapor environment and the output of which is attached to and feeding the pump, the collector output being formed to act as a capillary feeding liquid to the input of the pump and to cause collected liquid to bridge the cross section of the collector output without the aid of gravity; and transporting the condensed liquid from the area of condensation to the collector output by the use of a wettable inner surface of the collector.

* * * * *